US006572496B1

(12) United States Patent
Brown

(10) Patent No.: US 6,572,496 B1
(45) **Date of Patent: *Jun. 3, 2003**

(54) BASKETBALL REBOUND TRAINER

(76) Inventor: Jackie L. Brown, 125 2nd St., J.P.V., Winter Haven, FL (US) 33880

( * ) Notice: Subject to any disclaimer, the term of this patent is extended or adjusted under 35 U.S.C. 154(b) by 0 days.

This patent is subject to a terminal disclaimer.

(21) Appl. No.: 09/641,583

(22) Filed: Aug. 18, 2000

(51) Int. Cl.[7] ..... A63B 69/00; A63B 63/08; F41J 5/14

(52) U.S. Cl. ..... 473/449; 473/479; 473/485; 273/392

(58) Field of Search ..... 473/173, 422, 473/446–449, 481, 482, 485–489, 479, 433, 436, 438, 480, FOR 100, FOR 101; 273/317.3, 395, DIG. 31, 392, 473; 206/315.1; 124/16; 220/324; 217/89

(56) References Cited

U.S. PATENT DOCUMENTS

| | | | | | |
|---|---|---|---|---|---|
| 2,694,572 | A | | 11/1954 | Crisp | |
| 2,710,189 | A | | 6/1955 | Carroll | |
| 2,836,258 | A | * | 5/1958 | Price | 217/89 |
| 3,173,687 | A | | 3/1965 | Hair | |
| 3,348,840 | A | | 10/1967 | Dix | |
| 3,471,150 | A | | 10/1969 | Kaerwer | |
| 3,795,401 | A | | 3/1974 | Voltz et al. | |
| D233,162 | S | * | 10/1974 | Hayden | D21/780 |
| 3,910,574 | A | | 10/1975 | Voltz et al. | |
| 3,910,575 | A | * | 10/1975 | Miller | 473/447 |
| 4,976,355 | A | * | 12/1990 | Crutchfield | 206/457 |
| 5,507,484 | A | * | 4/1996 | Van Nimwegen et al. | 473/481 |
| 5,536,003 | A | * | 7/1996 | Brenner | 473/481 |
| 5,628,507 | A | * | 5/1997 | Johnson | 473/479 |
| 5,816,948 | A | * | 10/1998 | Davies, Jr. et al. | 473/485 |
| 5,881,583 | A | * | 3/1999 | Booker et al. | 473/485 |
| D429,784 | S | * | 8/2000 | Brown | D21/704 |

* cited by examiner

*Primary Examiner*—Paul T. Sewell
*Assistant Examiner*—Mitra Aryanpour

(57) ABSTRACT

A basketball rebound trainer for mounting in a basketball hoop has a body having a flexible surface and having filler material therein and an upper portion forming a basketball striking surface and a lower portion sized to fit into a basketball hoop and extending therebelow and a flanged support portion located between said upper body portion and the lower body portion and being sized to fit onto the basketball hoop to support the body. The body upper portion flexible surface has a plurality of generally rigid basketball striking surfaces mounted thereto through the flexible surface to a backing plate thereunder. The striking surfaces are generally wedged shaped and a plurality of the surfaces have an angle of approximately 30° to the horizontal plane of the hoop. The body flexible surface may include an inflatable bladder thereinside.

5 Claims, 3 Drawing Sheets

BASKETBALL REBOUND TRAINER

BACKGROUND OF THE INVENTION

The present invention relates to a basketball rebound training device for mounting to the hoops of a basketball goal and more particularly to a basketball rebound trainer which can be easily inserted and removed from the hoop.

To be an efficient basketball player requires training in rebounding and follow-up tip-in shots and it has become common practice to devote a great deal of practice to these skills. In order to provide the opportunity for the practice of such maneuvers, an initial shot must be missed. It is therefore difficult to duplicate actual game conditions in practice sessions with dependable regularity for a player to become proficient in rebounding.

In the past, it has become common to place an undersized ring on the basketball goal ring to obtain proficiency in shooting basketball goals. It has also been the practice on occasion to cover the basketball goal ring so that the ball will rebound therefrom to obtain practice in rebounding. In addition, rebounding devices have been known in the past as well as practice rings and a typical rebounding device might be clamped rigidly to the basketball hoop.

A typical basketball rebound practice device can be seen in the Hair patent, U.S. Pat. No. 3,173,687, in which a basketball rebound practice device fits the hoop of a basketball goal and provides ready determination of a successful goal attempt and a prompt return of the basketball to the playing area for successful rebounding or goal attempts. In the Dix patent, U.S. Pat. No. 3,348,840, a resiliently mounted basketball practice and rebound ring is mounted to a basketball hoop and includes a ring smaller than a basketball goal ring but larger than a basketball with resilient straps on the practice ring having hooks to connect the practice ring to the goal ring.

In the U.S. Pat. No. 2,710,189 to Carroll, a basketball tipping practice device is attached across the mouth of the basketball goal hoop. In the Voltz et al. patents, U.S. Pat. Nos. 3,910,574 & 3,795,401, a basketball rebound dome is provided in the shape of a convex surface member having a plurality of raised protuberances thereon against which a basketball may strike to cause erratic bouncing. The dome is held to the rim of a basketball goal by a plurality of radially extending clamps. In the Kaerwer patent, U.S. Pat. No. 3,471,150, a basketball goal ejector is provided while in the Crisp patent, U.S. Pat. No. 2,694,572, a basketball practice device made up of several rings attached to a frame which attaches to the basketball hoop and supports the ring and frame above the hoop to provide means for the. basketball players to practice his tipping and rebounding from the basket.

In contrast to these prior art rebound practicing devices, the present rebound trainer advantageously drops into the basketball goal hoop and supports itself to the hoop without any exterior clamps and is thus easily removed from the basketball hoop when the practice session has ended.

SUMMARY OF THE INVENTION

A basketball rebound trainer for mounting in a basketball hoop has a body having a flexible surface and having filler material therein and an upper portion forming a basketball striking surface and a lower portion sized to fit into a basketball hoop and extending therebelow and a flanged support portion located between said upper body portion and the lower body portion and being sized to fit onto the basketball hoop to support the body. The body upper portion flexible surface has a plurality of generally rigid basketball striking, surfaces mounted thereto through the flexible surface to a backing plate thereunder. The striking surfaces are generally wedged shaped and a plurality of the surfaces have an angle of approximately 30° to the horizontal plane of the hoop. The body flexible surface may include an inflatable bladder thereinside.

BRIEF DESCRIPTION OF THE DRAWINGS

Other objects, features, and advantages of the present invention will be apparent from the written description and the drawings in which.

DESCRIPTION OF THE PREFERRED EMBODIMENTS

Figure 1:
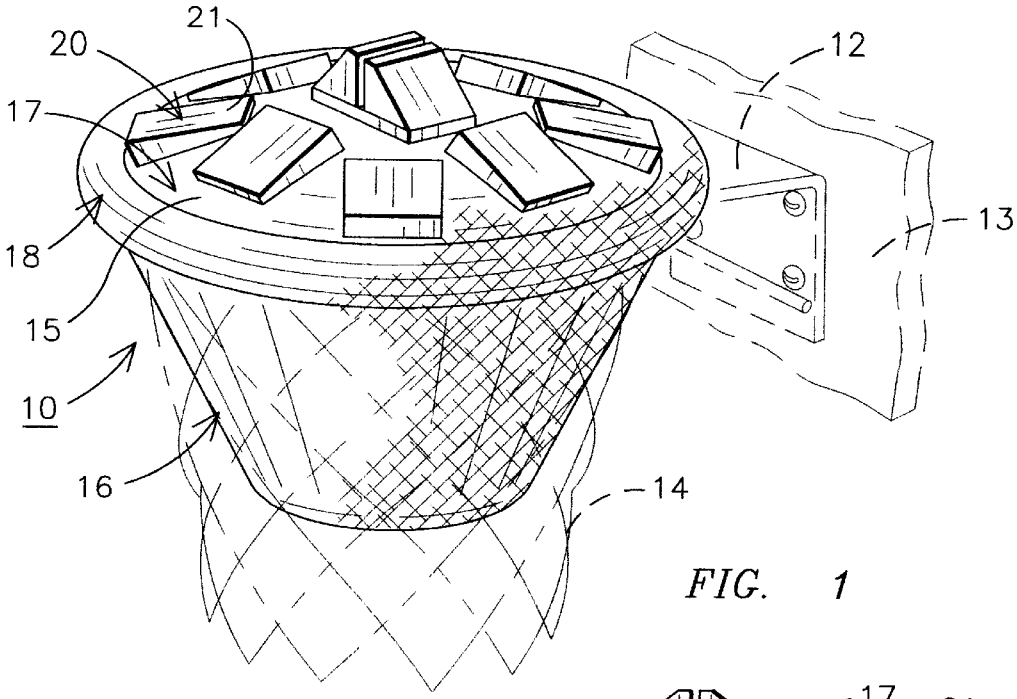
FIG. 1 is a perspective view of a basketball rebound trainer in accordance with the present invention shown attached to a basketball hoop.
Figure 2:
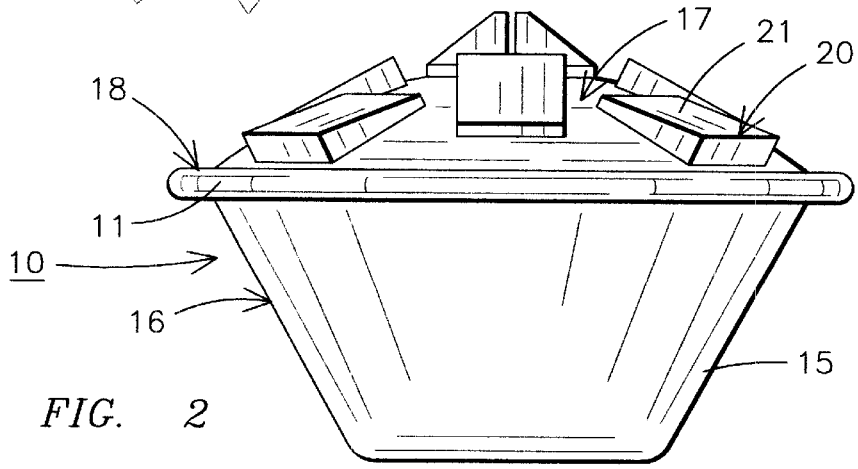
FIG. 2 is a side elevation of the basketball rebound trainer of FIG. 1.

Referring to the drawings of FIGS. 1–6, a basketball rebound trainer 10 for mounting in a basketball goal hoop 11 is supported with a bracket 12 to a basketball goal backboard 13. The hoop 11 has a net 14 hanging therefrom. The basketball rebound trainer is made of a flexible outer material 15 and has a lower portion 16 for fitting through the hoop 11 and extending to the bottom thereof. The trainer 10 has an upper portion 17 forming a basketball striking surface and extending above the hoop 11 when the trainer is mounted in the hoop. A flanged support portion 18 is located between the upper body portion 17 and the lower body portion 16 and fits onto the basketball hoop 11 to support the upper portion above the basketball hoop and the lower portion below the basketball hoop 11. The upper portion 17 has a plurality of generally wedge shaped basketball striking surfaces 20 mounted to the upper portions flexible skin. The striking portions 20 generally have an angle 21 which is calculated to be approximately 30° from the horizontal plane of the hoop 11. At this point, it can be seen that the basketball rebound trainer 10 can be simply dropped into the center of the basketball goal hoop 11 where it will be supported by the flange 18 and held in place by the weight of the lower portion 16. Basketballs which are shot towards the goal will hit the upper portion 17 basketball striking surfaces 20 and will be deflected therefrom at differing directions and at differing angles to allow a basketball player to practice rebounding in a manner similar to rebounding a missed shot in a basketball game. Once the training session has been completed, the basketball rebound trainer can simply be pulled from the top of the hoop 11 so that the basketball goal can then be used in a basketball game or for training purposes. The basketball rebound trainer 10 flexible surface 15 can be seen as being filled with a loose ballast material 23 for adding weight to the bottom portion 16 for holding the rebound trainer 10 in a basketball hoop 11. However, FIG. 6 has a preferred embodiment without the ballast.

Figure 3:
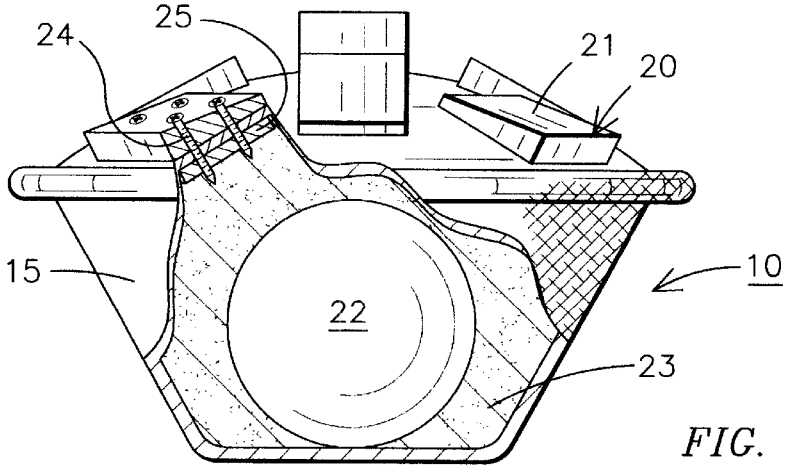
FIG. 3 is a cutaway side elevation of the basketball rebound trainer of FIGS. 1 and 2.
Figure 4:
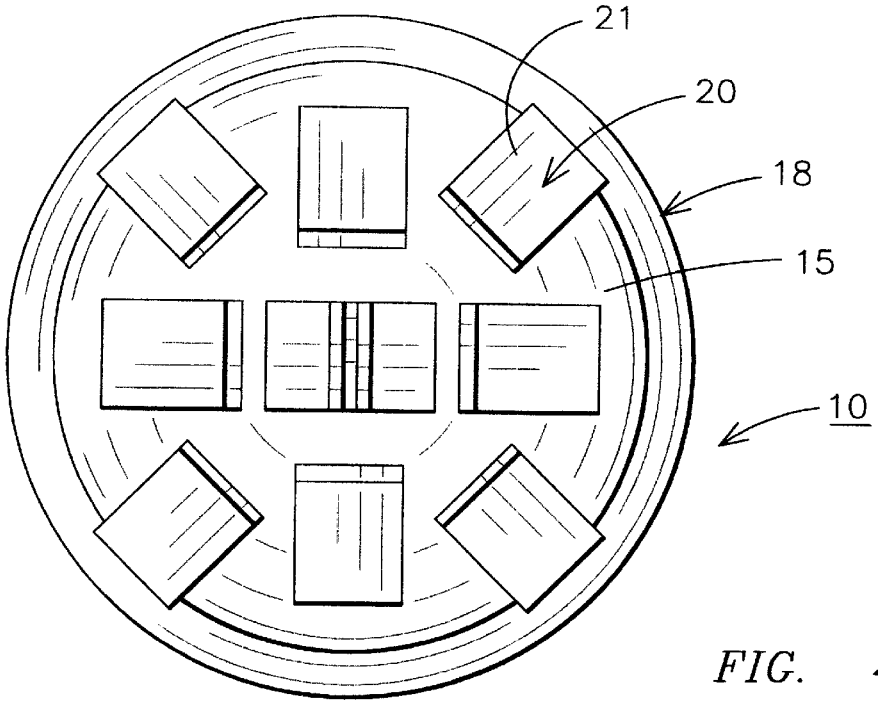
FIG. 4 is a top plan view of the basketball rebound trainer of FIGS. 1–3.
Figure 5:
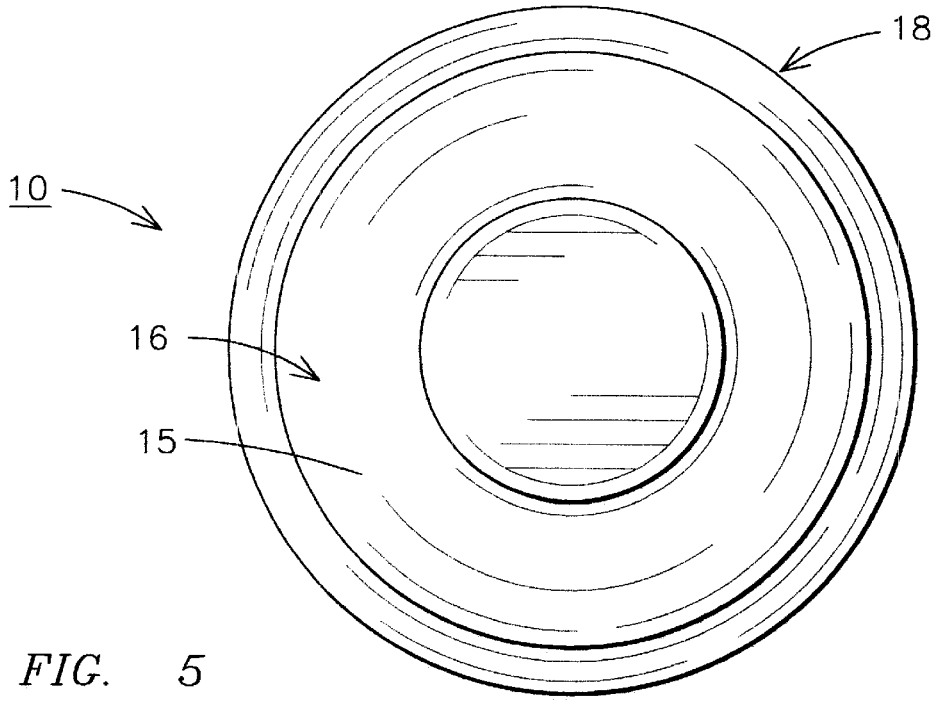
FIG. 5 is a bottom plan-view.
Figure 6:
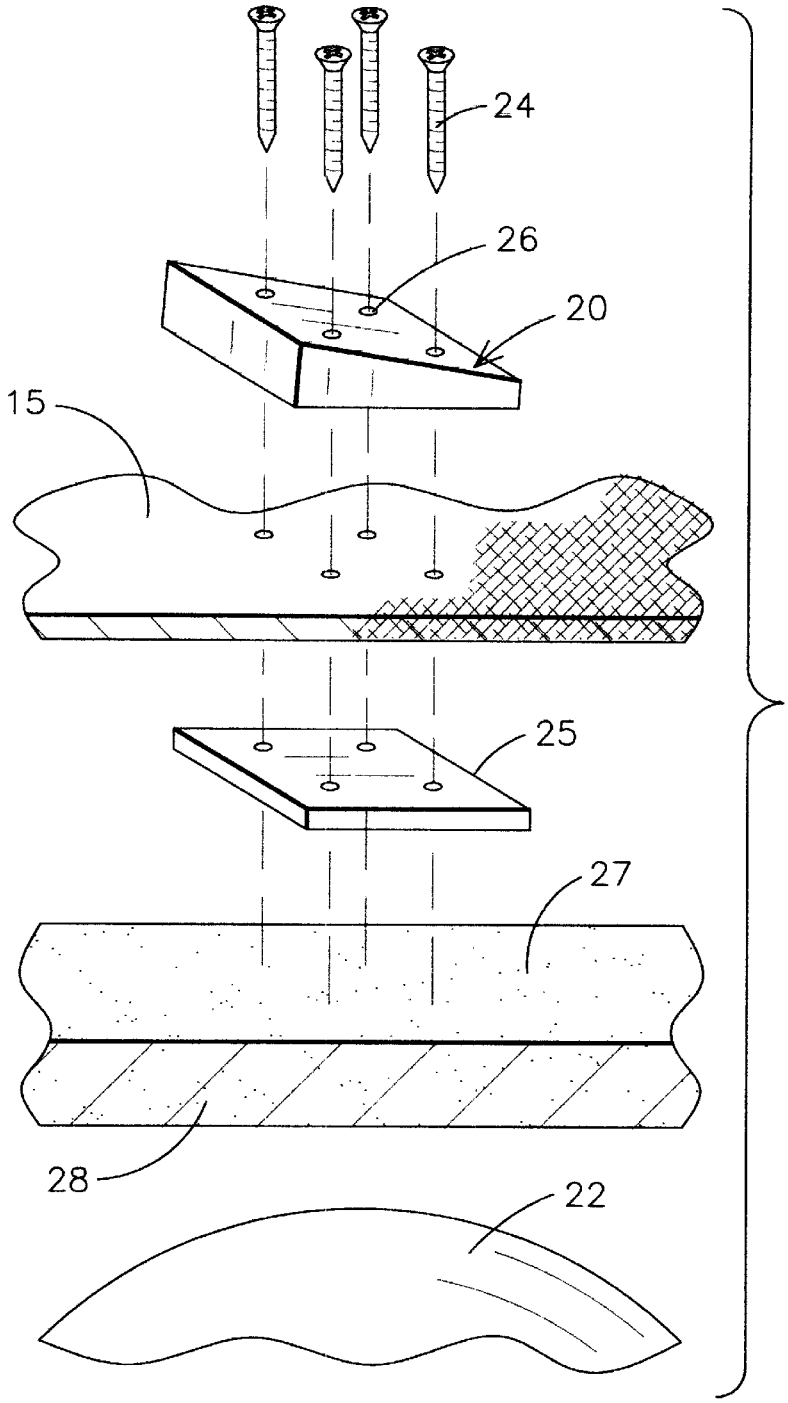
FIG. 6 is an exploded perspective view of the attachment of a basketball striking surface mounted to the body of the basketball rebound trainer.

As seen in FIG. 3, an inflatable bladder 22, such as an inexpensive basketball or toy, can be inserted in the middle of the trainer 10 to reduce the amount of ballast 23 which can be sand or any fluid solid material desired. The basketball striking surface 20 has a surface 21 which can be seen having a plurality of threaded fasteners 24 attaching each rigid striking surface 20 through the flexible outer surface 15 and into a supporting plank 25 so that the striking surface 20 will be well anchored to the flexible skin, as more clearly seen in the embodiment of FIG. 6. The striking surface may be made of wood or plastic or any rigid surface desired. The plurality of fasteners 24 are attached through openings 26 in the striking surface 20 and through the fabric material 15 and into the supporting plank 25 but may also extend into a further backing of a foamed polymer panel 27 mounted to a second foamed polymer panel 28 to prevent the threaded fasteners 24 from puncturing the inflatable bladder 22. The anchoring method for the basketball striking surfaces 20 is calculated to be roughly about 30° to the plane of the hoop and the striking surfaces can be made of a wood or any rigid material desired. The outer surface 15 can be of any flexible material of sufficient strength to hold a ballast and for attaching the rigid basketball striking surfaces 20 and can be of a fabric or flexible polymer material or any material desired. The inflatable bladder 22 can be inflated to a lesser or greater degree of pressure so that the basketball hitting the rebound surface will rebound differently.

It should be clear at this time that a basketball rebound trainer has been provided which advantageously drops into an existing basketball goal hoop for practicing rebounding and the rebound trainer can be rapidly removed from the hoop for playing basketball. The base of the lower portion has a zipper therein for access to the ball. However, the present invention is not to be construed as limited to the forms shown which are to be considered illustrative rather than restrictive.

I claim:

1. A basketball rebound trainer for mounting in a basketball hoop comprising:

a body having a flexible surface and having fluid solid filler material therein and having an upper portion forming a basketball striking surface and a lower portion sized to fit into a basketball hoop and extending therebelow and a flange support portion located between said upper body portion and said lower body portion and sized to fit onto said basketball hoop to support said upper portion above said basketball hoop and said lower body portion below said basketball hoop, said upper body portion flexible surface having a plurality of generally inflexible basketball striking surfaces mounted thereto, each said striking surface being separately attached through said flexible surface upper body portion and each said striking surface having a generally angled surface thereon for deflecting a basketball hitting said upper striking surface whereby a basketball rebound trainer can be attached to a basketball hoop by dropping the lower body portion through a basketball hoop with said flange portion resting on said hoop and removed from said basketball hoop by lifting said body from said hoop, and wherein said body's flexible surface is a flexible fabric, and said flexible surface further has an inflatable bladder therein side.

2. A basketball rebound trainer for mounting in a basketball hoop in accordance with claim 1 in which said plurality of striking surfaces are made of plastic.

3. A basketball rebound trainer for mounting in a basketball hoop in accordance with claim 1 in which said plurality of striking surfaces are made of wood.

4. A basketball rebound trainer for mounting in a basketball hoop in accordance with claim 1 in which a plurality of said striking surfaces are each generally wedge shaped.

5. A basketball rebound trainer for mounting in a basketball hoop in accordance with claim 1 in which a plurality of striking surfaces each has a backing plate on the opposite side of said upper body portion flexible surface attached thereto.

* * * * *